US012416406B2

(12) United States Patent
Hamidian

(10) Patent No.: US 12,416,406 B2
(45) Date of Patent: Sep. 16, 2025

(54) LIGHTER CASE

(71) Applicant: Danesh Hamidian, Richmond Hill (CA)

(72) Inventor: Danesh Hamidian, Richmond Hill (CA)

(73) Assignee: Danesh Hamidian, Richmond Hill (CA)

( * ) Notice: Subject to any disclaimer, the term of this patent is extended or adjusted under 35 U.S.C. 154(b) by 387 days.

(21) Appl. No.: 17/982,037

(22) Filed: Nov. 7, 2022

(65) Prior Publication Data

US 2024/0151395 A1 May 9, 2024

(51) Int. Cl.
*F23Q 2/50* (2006.01)
*F23Q 2/36* (2006.01)

(52) U.S. Cl.
CPC *F23Q 2/50* (2013.01); *F23Q 2/36* (2013.01)

(58) Field of Classification Search
CPC ..... F23Q 2/36; F23Q 2/50
See application file for complete search history.

(56) References Cited

U.S. PATENT DOCUMENTS

| | | | |
|---|---|---|---|
| 4,640,679 | A | 2/1987 | Perrin |
| 4,653,999 | A | 3/1987 | Dennis, Jr. et al. |
| 5,044,933 | A | 9/1991 | Yang |
| D783,201 | S | 4/2017 | Pierce et al. |
| 2014/0011144 | A1 | 1/2014 | Hancock et al. |

FOREIGN PATENT DOCUMENTS

| | | | |
|---|---|---|---|
| JP | H08178283 | * | 7/1996 |
| JP | 2000283461 | * | 10/2000 |
| KR | 20110003945 | U | 4/2011 |

* cited by examiner

*Primary Examiner* — Alfred Basichas
(74) *Attorney, Agent, or Firm* — Rowand LLP

(57) ABSTRACT

A lighter case for holding a lighter is disclosed. The lighter case includes: a case body having a first end and a second end opposite the first end, the case body defining a first opening at the first end and a cavity for receiving and retaining the lighter therein, the cavity extending from the first opening toward the second end; and a wind guard slidably coupled to the case body, the wind guard being slidable axially relative to a length of the case body between a retracted position and an extended position, wherein the wind guard comprises a partial cylindrical guard wall defining a central interior space and wherein the guard wall defines an access opening for accessing the central interior space.

12 Claims, 8 Drawing Sheets

LIGHTER CASE

TECHNICAL FIELD

The present disclosure relates to lighter accessories and, in particular, to a lighter case for holding a lighter.

BACKGROUND

Lighters are used to ignite a variety of items such as cigarettes, candles, fireworks, and the like. Using a lighter to produce a flame while outdoors is challenging in windy conditions or significant precipitation (e.g., snow, rain, etc.).

BRIEF DESCRIPTION OF DRAWINGS

Reference will now be made, by way of example, to the accompanying drawings which show example embodiments of the present application and in which.

Like reference numerals are used in the drawings to denote like elements and features.

DETAILED DESCRIPTION OF EXAMPLE EMBODIMENTS

Figure 1:
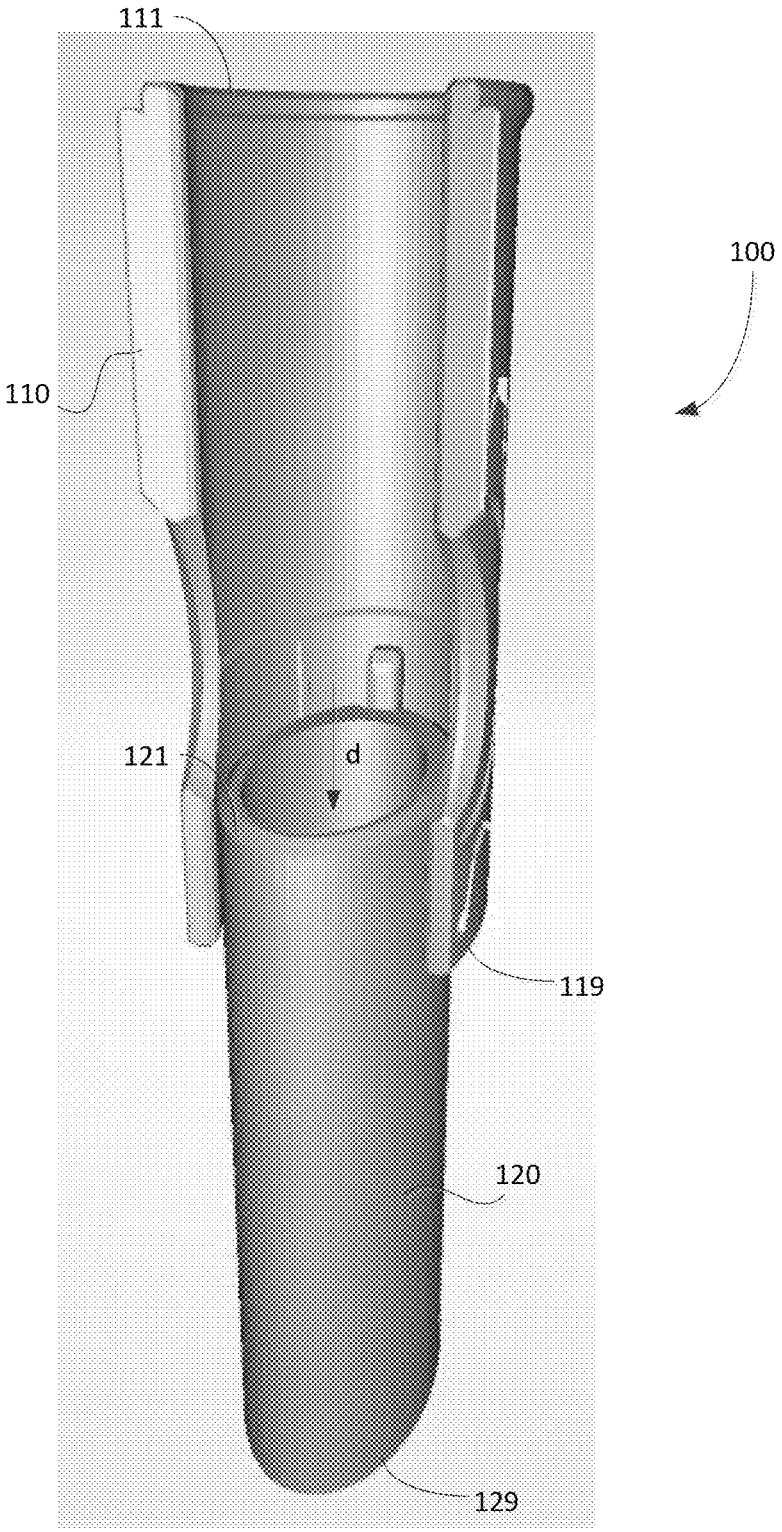
FIG. 1 shows the components of a lighter case in accordance with an example embodiment of the present disclosure.

In an aspect, the present disclosure describes a lighter case for holding a lighter. The lighter case includes a case body. The case body has a first end and a second end opposite the first end. The case body defines a first opening at the first end and a cavity for receiving and retaining the lighter therein. The cavity extends from the first opening toward the second end of the case body. The lighter case also includes a wind guard that is slidably coupled to the case body. The wind guard is slidable axially relative to a length of the case body between a retracted position and an extended position. The wind guard may comprise a partial cylindrical guard wall that defines a central interior space. The guard wall defines an access opening that allows for access to the central interior space.

In some implementations, the case body may comprise an elongate tubular member and the central interior space may be shaped and sized to receive the elongate tubular member in the retracted position.

In some implementations, the cavity may comprise a bore that extends at least partially through the case body from the first end toward the second end.

In some implementations, a length of the bore may be less than a length of the lighter such that at least a portion of the lighter is exposed beyond the case body when the lighter is received in the bore.

In some implementations, the length of the bore may be such that a flame-producing portion of the lighter is substantially exposed beyond the case body.

In some implementations, the case body may define one or more guide grooves extending longitudinally on an exterior surface of the case body and the wind guard may define one or more projections corresponding to the guide grooves on an interior surface of the wind guard, each projection being fitted into and sliding in a corresponding guide groove.

In some implementations, at least one of the guide grooves may include one or more stopper elements therein for limiting sliding movement of a corresponding projection in the at least one guide groove.

In some implementations, the wind guard may include a cut-away portion on the guard wall at the access opening for accommodating positioning a thumb to ignite the lighter when the wind guard is in the extended position.

In some implementations, the guard wall may include a rim portion extending perpendicularly outward from a top end of an exterior surface of the guard wall.

In some implementations, the guard wall may include a first side end and a second side end and the guard wall may include, for each of the side ends, a side rim portion extending perpendicularly outward from an exterior surface of the guard wall at the side end.

In some implementations, at least one of the case body or the wind guard may be constructed out of plastic.

In some implementations, at least one of the case body or the wind guard may be constructed out of a metallic alloy.

In some implementations, the guard wall may define an interior surface of the wind guard and the interior surface comprise fireproof or fire-resistant material.

Other example embodiments of the present disclosure will be apparent to those of ordinary skill in the art from a review of the following detailed descriptions in conjunction with the drawings.

In the present application, the term "and/or" is intended to cover all possible combination and sub-combinations of the listed elements, including any one of the listed elements alone, any sub-combination, or all of the elements, and without necessarily including additional elements.

In the present application, the phrase "at least one of . . . or . . . " is intended to cover any one or more of the listed elements, including any one of the listed elements alone, any sub-combination, or all of the elements, without necessarily excluding any additional elements, and without necessarily requiring all of the elements.

Lighters are difficult to operate outdoors in windy conditions, as the wind may interfere with or prevent a flame from being produced upon ignition. Using one's hand to shield the flame-producing parts of a lighter from wind typically does little to mitigate the effects of the interference. It is desired to provide a lightweight accessory for lighters that can be used outdoors for facilitating ignition.

The present disclosure describes a lighter case, or holder, for holding a lighter. The lighter case includes a wind guard for shielding a flame-producing portion of a lighter from ambient wind. In particular, the lighter case can be manipulated to move the wind guard into a position in which the wind guard can block wind to allow a flame to be produced and various items (e.g., cigarette, kindling materials, etc.) to be ignited using the lighter.

Reference is first made to FIG. 1, which shows a perspective view of an example lighter case 100 for holding a lighter. The lighter case 100 may be constructed in different sizes to accommodate use with different types and/or sizes of lighters. The lighter case 100 includes a wind guard 110 and a case body 120. The case body 120 is adapted to receive and hold a lighter therein. The wind guard 110 is coupled to the case body 120 and is used to block out wind which may prevent a flame from being produced by a lighter held in the case body 120. The wind guard 110 and the case body 120 may be integrally constructed into a single lighter case unit, or they may be separate components that are assembled to form a lighter case. The case body 120 and/or the wind guard 110 may be constructed out of plastic. Additionally, or alternatively, at least one of the case body 120 or the wind guard 110 may be constructed out of a metallic alloy.

Figure 3:
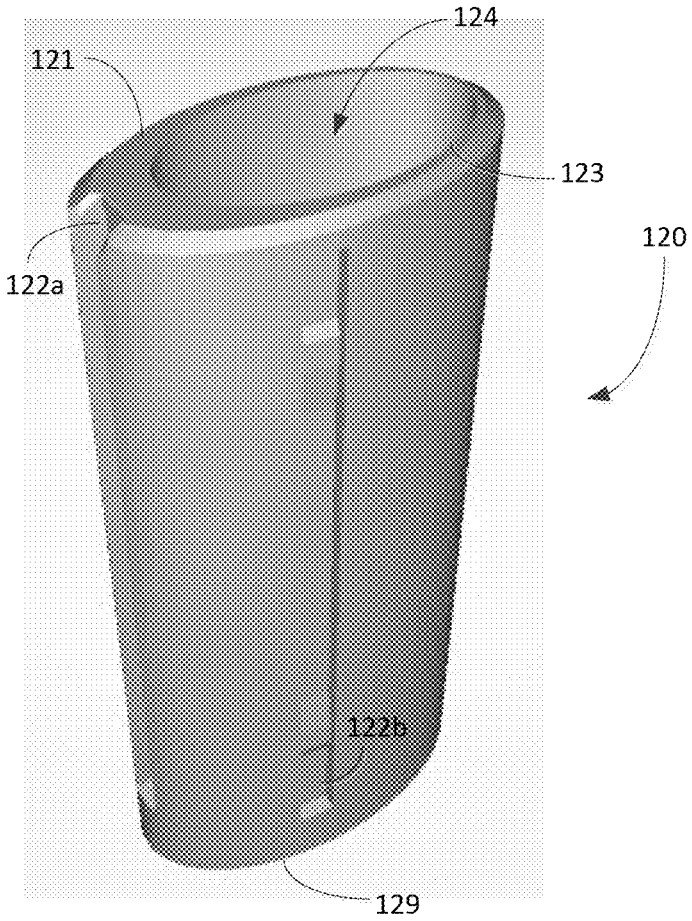
FIG. 3 is a perspective view of a case body of the lighter case of FIG. 1.

As shown in FIG. 3, the case body 120 has a generally elongate shape. The case body 120 may, for example, comprise an elongate tubular member. The case body 120 has a first end 121 and a second end 129 opposite the first end 121. The case body 120 defines a first opening 123 at the first end 121, and a cavity 124 for receiving and retaining a lighter (e.g., a housing of a lighter) therein. The cavity 124 extends from the first opening 123 toward the second end 129. That is, the first opening 123 serves as an entrance to the cavity 124. The cavity 124 may, for example, comprise a bore that extends at least partially through the case body 120 from the first end 121 toward the second end 129. The bore may generally have the shape of a lighter. A lighter can be inserted into the cavity 124 such that the lighter, or a portion thereof, is retained inside the cavity 124.

In at least some embodiments, the length of the cavity 124 (e.g., bore) is less than the length of the lighter that is inserted in the cavity 124. In particular, at least a portion of the lighter may be exposed beyond the case body 120 such that a user can operate the lighter while it is disposed inside the cavity 124. For example, the case body 120 may be constructed with a defined length for the cavity 124 such that a flame-producing portion of the lighter is substantially exposed beyond the case body 120. That is, at least part of a flame-producing portion of the lighter may remain outside of the cavity 124 and beyond the first end 121 of the case body 120 when the lighter is inserted into the cavity 124. The flame-producing portion may include, for example, a spark wheel (for a flint igniter) or a button (for a piezoelectric igniter), a hood, and a fork. In some embodiments, the case body 120 may include a stopper element disposed inside the cavity 124 to prevent the lighter from being inserted deeper into the cavity 124. For example, a raised projection may extend inwardly from an interior surface of the cavity 124 such that the lighter is supported above the raised projection when it is inserted into the cavity 124.

Figure 2B:
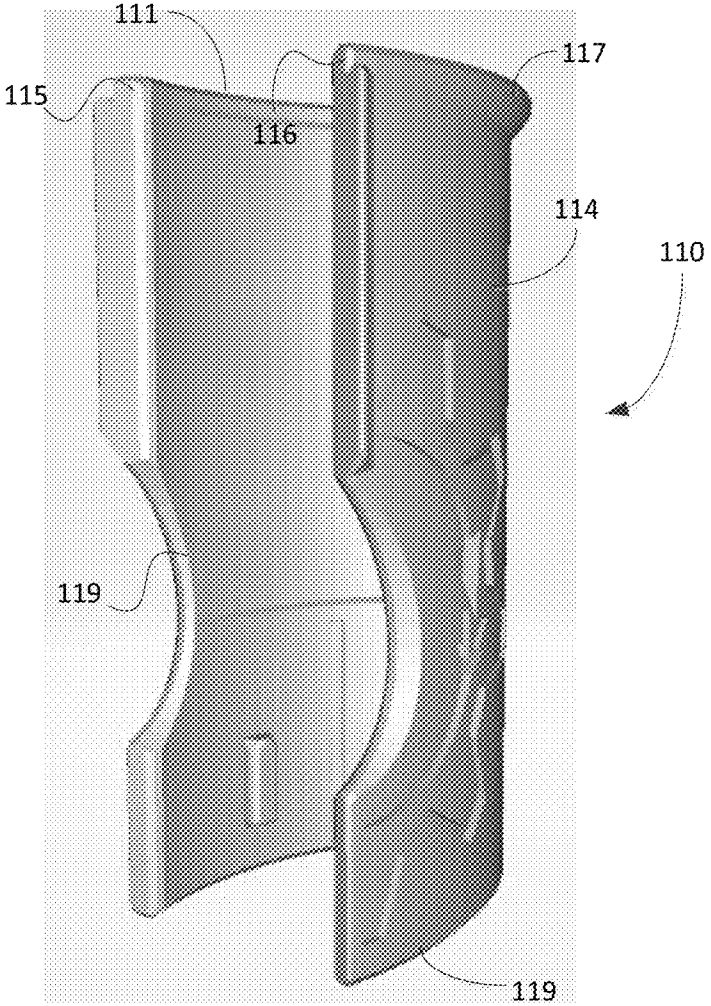
FIGS. 2A and 2B are perspective views of a wind guard of the lighter case of FIG. 1.
Figure 2A:
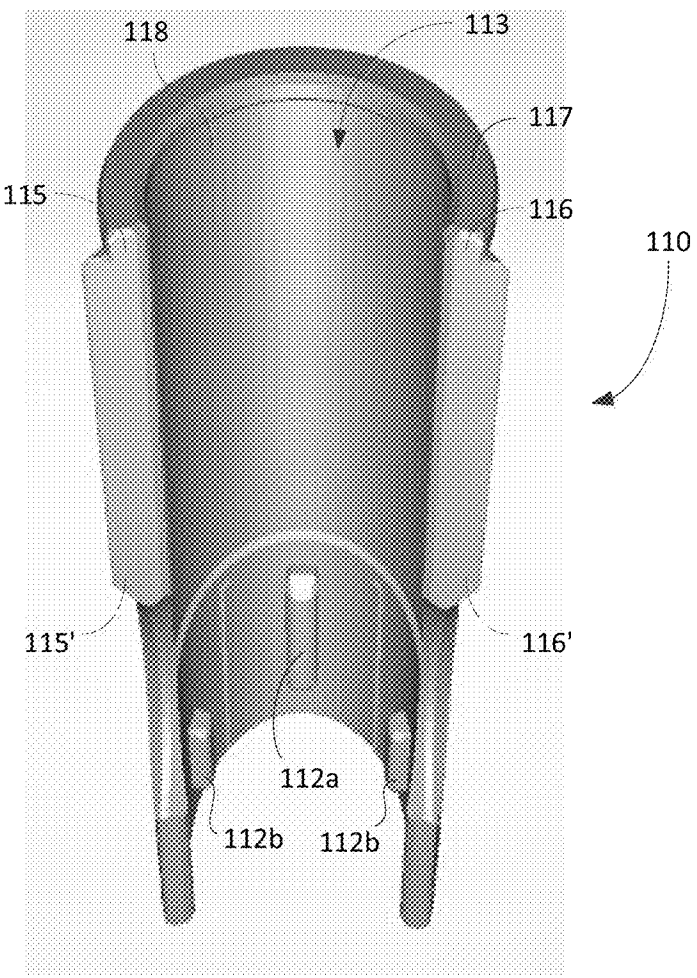

The lighter case 100 also includes a wind guard 110. An example embodiment of a wind guard 110 is illustrated in FIGS. 2A and 2B. The wind guard 110 shown in this example comprises a partial cylindrical guard wall 114. In particular, the guard wall 114 extends between a first side end 115 and a second side end 116. The guard wall 114 defines a central interior space 113 of the wind guard 110. The guard wall 114 blocks wind from entering the central interior space 113. For example, when in use, the lighter case 100 may be held by a user such that the guard wall 114 is oriented to block the wind, e.g., against the wind flow. This allows a flame to be produced from the lighter upon ignition, without (or with reduced) wind interference, inside the central interior space 113.

The guard wall 114 also defines an access opening for accessing the central interior space 113. In some embodiments, the access opening may comprise an opening between the first side end 115 and the second side end 116 of the guard wall 114. The guard wall 114 defines an interior surface 118 of the wind guard 110. The interior surface 118 comprises fireproof or fire-resistant material. For example, the interior surface may be completely or partially coated using fireproof/fire-resistant material.

Returning to FIG. 1, the wind guard 110 is slidably coupled to the case body 120.

Figure 4:
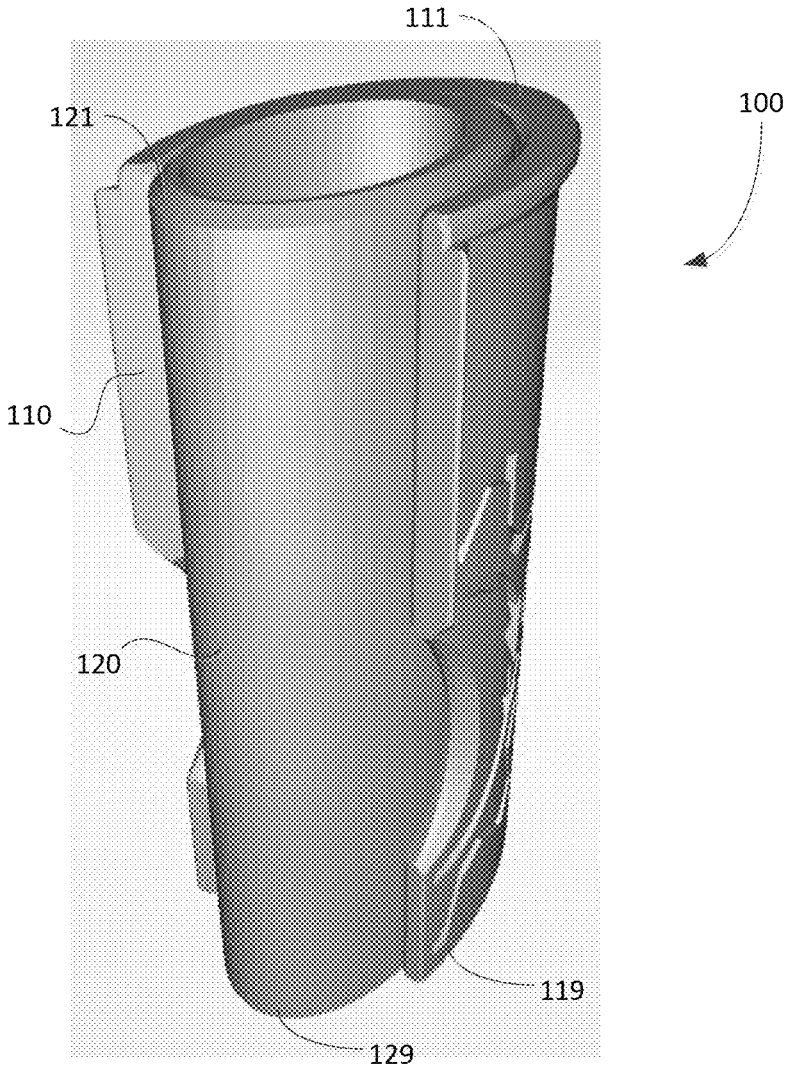
FIG. 4 is a perspective view of the lighter case of FIG. 1 in a retracted configuration.

Specifically, the wind guard 110 is slidable axially relative to a length of the case body 120. The wind guard 110 may slide between a retracted position and an extended position. In the retracted position (FIG. 4), the lighter case 100 is in a compact form in which the wind guard 110 substantially overlaps with and covers part of the exterior of the case body 120. The wind guard 110 may be in the retracted position by default or when, for example, blocking of wind is not needed for a lighter to produce a flame upon ignition. In the example of FIG. 4, the case body 120 is an elongate tubular member and the central interior space 113 is shaped and sized to cover over the elongate tubular member in the retracted position.

FIG. 1 shows the wind guard 110 in an extended position. In the extended position, the wind guard 110 serves to block out wind such that a lighter that is held in the cavity 124 of the case body 120 may produce a flame without (or with reduced) wind interference. In particular, the wind guard 110 blocks wind from reaching a flame-producing portion of the lighter that is exposed beyond the case body 120. Items to be ignited, such as a cigarette, candle, kindling materials, etc., may be inserted into the central interior space 113 defined by the guard wall 114 and make contact with a flame that is produced by the lighter held in the case body 120.

The wind guard 110 is configured to slidably move relative to the case body 120. Similarly, the case body 120 is slidable relative to the wind guard 110. In particular, the case body 120 may slide axially in the direction "d" indicated in FIG. 1. When the wind guard 110 is in the retracted position, a user can push on a portion of the case body 120 and/or a lighter that is held in the cavity 124 of the case body 120 to cause the case body 120 to slide along "d" away from the wind guard 110. That is, the case body 120 may be slidable to move the wind guard 110 to the extended position. The first end 121 and the second end 129 of the case body 120 are caused to move away from the first end 111 and the second end 119 of the wind guard 110, respectively, by the sliding movement of the case body 120. As shown in FIG. 1, in the extended position of the wind guard 110, the first end 111 is at its further point from the first end 121, and the second end 119 is at its furthest points from the second end 129.

In some embodiments, the case body 120 defines one or more guide grooves, such as 122*a* and 122*b* of FIG. 3, that extend longitudinally along an exterior of the case body 120. For example, guide grooves 122*a* and 122*b* may be defined on an exterior surface of the case body 120. The wind guard 110 may define one or more raised projections, such as 112*a* and 112*b* of FIG. 2A, corresponding to the guide grooves. The raised projections may be disposed on an interior surface of the wind guard 110. Each projection 112*a* and 112*b* may be configured to slidingly engage with a corresponding one of the guide grooves 122*a* and 122*b*. Specifically, the projections (112*a*, 112*b*) may fit into and slide along respective ones of the guide grooves (122*a*, 122*b*) to allow the wind guard 110 to slidingly move relative to the case body 120.

In at least some embodiments, the sliding movement of the wind guard 110 may be controlled. In particular, the range of sliding may be restricted. For example, at least one of the guide grooves 122*a* and 122*b* may include one or more stopper elements disposed therein for limiting the sliding movement of a corresponding projection in the at least one guide groove. The stopper elements may, for example, be ridges (or protrusions, etc.) that are disposed in the guide grooves for blocking movement beyond the stopper elements. The stopper elements may thus represent end points of the range of sliding for the wind guard 110 relative to the case body 120.

In some embodiments, the sliding movement of the wind guard 110 may be controlled using magnets. The case body 120 may define tracks (or guide grooves, and the like) thereon for guiding the sliding movement of the wind guard 110 relative to the case body 120. For example, the case body 120 may include longitudinal tracks that are defined on an external surface of the case body 120. The wind guard 110 may include one or more sliding members that are configured to slidingly engage with corresponding tracks of the case body 120. The tracks of the case body 120 may include stopper or locking elements. The sliding members and the stopper/locking elements of the tracks may cooperate to guide the sliding movement of the wind guard 110 and to lock the wind guard 110 and the case body 120 in a fixed relative position relative to each other. For example, the stopper/locking elements may comprise magnets, and each of the sliding members may be locked in a fixed position along the tracks due to the attractive force between the sliding members and the respective stopper/locking elements.

The light case 100 may include a mechanism for ensuring that the wind guard 110 and the case body 120 do not inadvertently move with respect to each other. When the wind guard 110 is not needed for use as a shield, it is desirable to maintain the wind guard 110 in the retracted form and to prevent it from sliding relative to the case body 120. In some embodiments, a spring-loaded locking mechanism may be employed for locking the wind guard 110 in the retracted form. In the locked state, the wind guard 110 is in the retracted form and is not movable relative to the case body 120. A user can push-to-release on a portion of the wind guard 110 to release it from the locked state, allowing the wind guard 110 to move freely upon release. The wind guard 110 can be returned to the locked state by pushing-to-lock on the wind guard 110 when it is brought back to its retracted form.

As shown in FIG. 2B, the wind guard 110 may include a cut-away portion 118 defined on the guard wall 114 at the access opening. The cut-away portion 118 may accommodate a user positioning their thumb to ignite a lighter when the wind guard 110 is in the extended position. In particular, a user's thumb may slide along the cut-away portion 118 as part of a motion for igniting the lighter. The shape of the cut-away portion 118 may allow different portions of a user's thumb (e.g., outer thumb, inner thumb, etc.) to slide along the cut-away portion 118 for igniting the lighter.

In some embodiments, the guard wall 114 may include a rim portion 117 extending along a top end of the guard wall 114. Specifically, the rim portion 117 may extend outward from a top end of an exterior surface of the guard wall 114. Additionally, or alternatively, the guard wall 114 may include, for each of the first and second side ends 115 and 116, a side rim portion 115' and 116', respectively, that extends perpendicularly outward from an exterior surface of the guard wall 114 at the side end. The rim portion 117 and the side rim portions 115' and 116' at the side ends 115 and 116 may serve as wind diverters that are designed to cause turbulence above and around open sides of the guard wall 114. The turbulence may serve to slow down ambient wind and cause the slowed layer to act as a barrier, preventing faster wind from curving around and preventing ignition.

Figure 5:
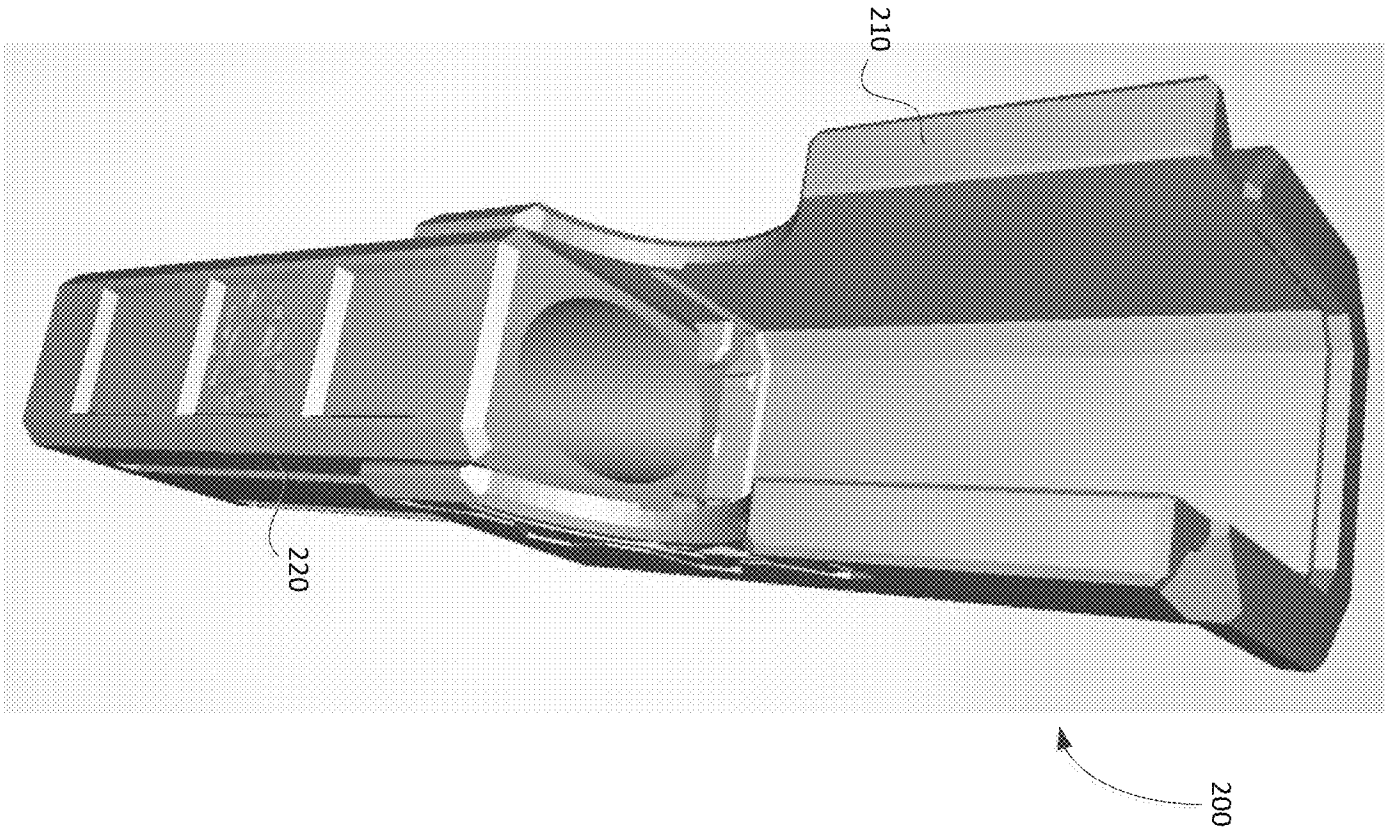
FIG. 5 shows the components of a lighter case in accordance with another example embodiment of the present disclosure.
Figure 6:
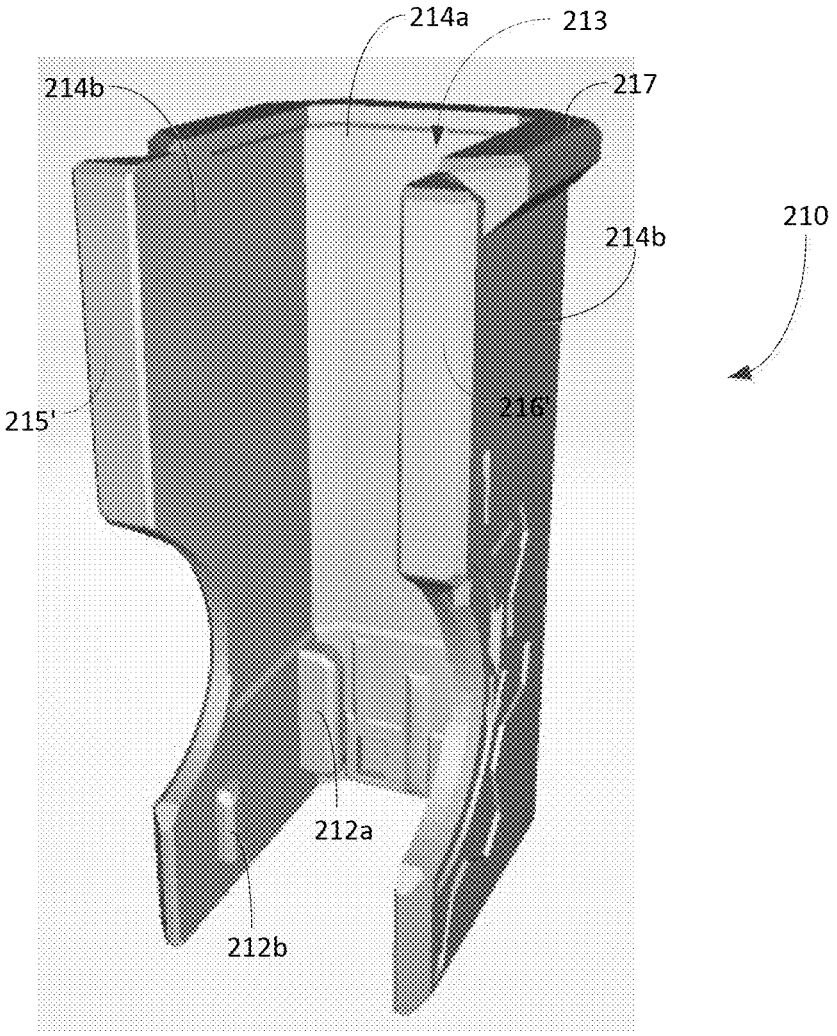
FIG. 6 shows a perspective view of a wind guard of the lighter case of FIG. 5.
Figure 7:
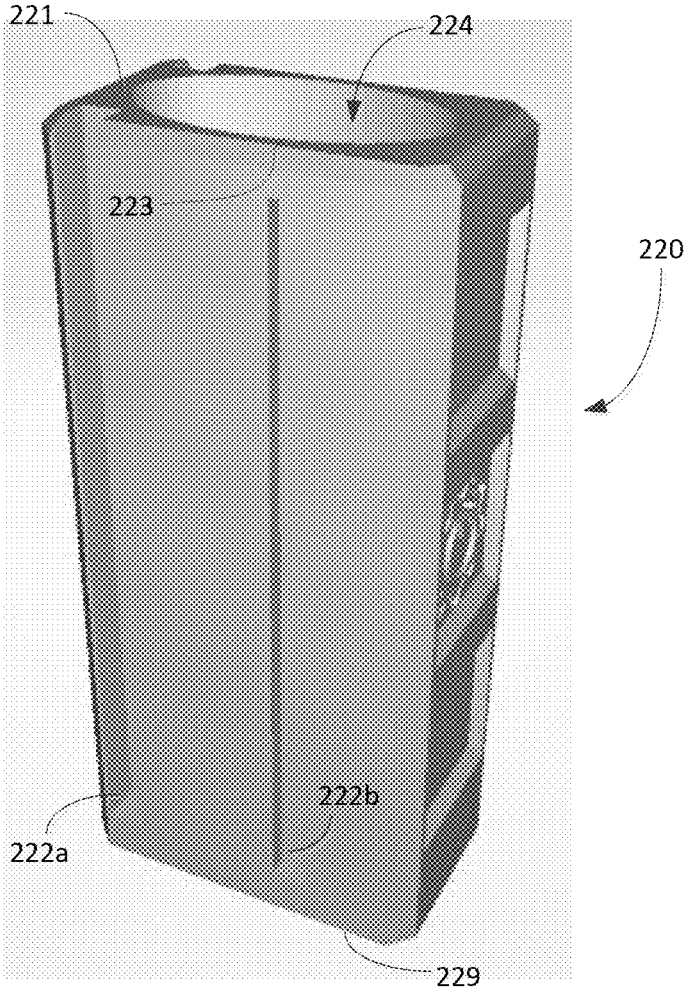
FIG. 7 is a perspective view of a case body of the lighter case of FIG. 5.
Figure 8:
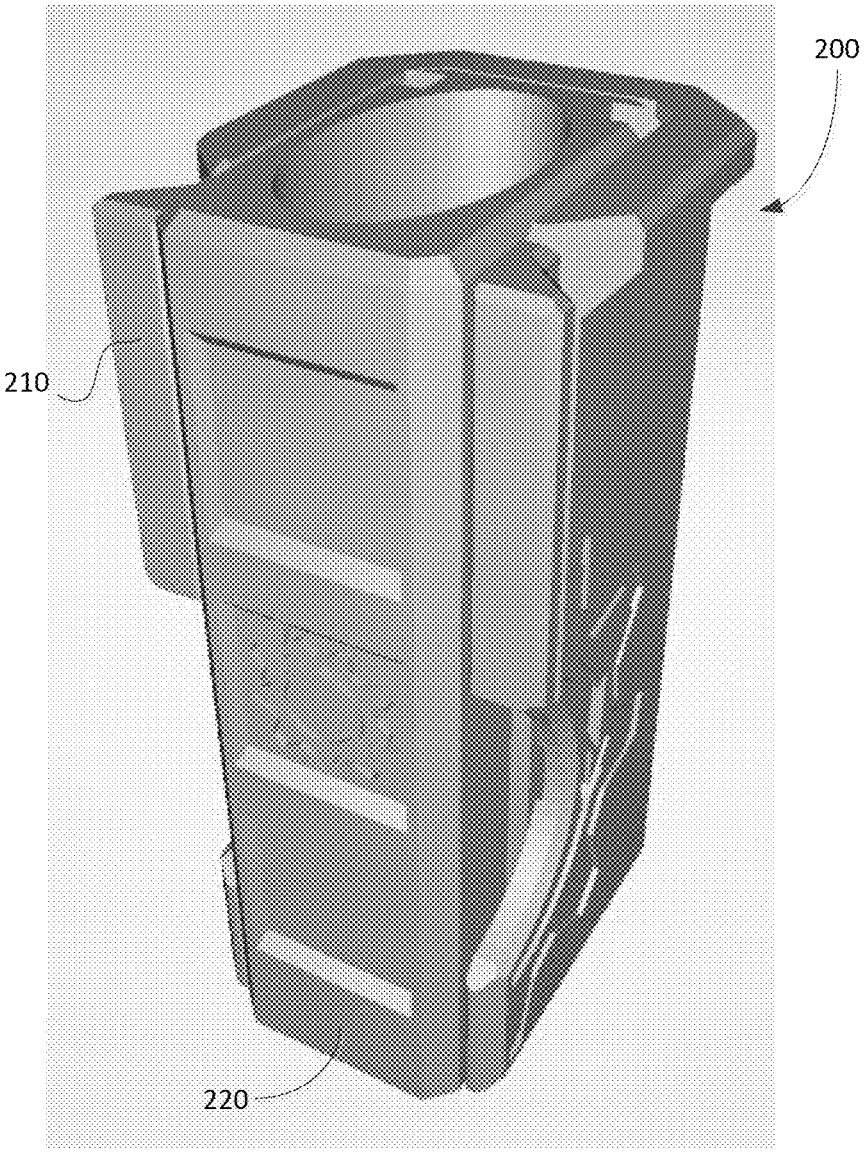
FIG. 8 is a perspective view of the lighter case of FIG. 5 in a retracted configuration.

FIG. 5 illustrates another example embodiment of a lighter case 200. The lighter case 200 includes a wind guard 210 and a case body 220. The wind guard 210 is slidably coupled to the case body 220. The wind guard 210 includes a first wall 214*a* and second side walls 214*b*. The first wall 214*a* and the second side walls 214*b* define a central interior space 213. The wind guard 210 also defines a top rim 217 and side rims 215' and 216' for diverting ambient wind on an outer surface of the wind guard 210.

The case body 220 includes a cavity 224 extending from a first opening 223 at a first (top) end 221 of the case body 220 and extending toward a second end 229 of the case body 220 opposite the first end. The case body 220 defines guide grooves 222*a* and 222*b* extending longitudinally on an exterior surface of the case body 220. The wind guard 210 defines one or more raised projections 212*a* and 212*b* on an interior surface of the wind guard 210, with each projection being configured to slidingly engage with a corresponding one of the guide grooves 222*a* and 222*b*. Specifically, the projections may each fit into and slide along respective ones of the guide grooves.

The various embodiments presented above are merely examples and are in no way meant to limit the scope of this application. Variations of the innovations described herein will be apparent to persons of ordinary skill in the art, such variations being within the intended scope of the present application. In particular, features from one or more of the above-described example embodiments may be selected to create alternative example embodiments including a sub-combination of features which may not be explicitly described above. In addition, features from one or more of the above-described example embodiments may be selected and combined to create alternative example embodiments including a combination of features which may not be explicitly described above. Features suitable for such combinations and sub-combinations would be readily apparent to persons skilled in the art upon review of the present application as a whole. The subject matter described herein and in the recited claims intends to cover and embrace all suitable changes in technology.

The invention claimed is:

1. A lighter case for holding a lighter, comprising:

a case body having a first end and a second end opposite the first end, the case body defining a first opening at the first end and a cavity for receiving and retaining the lighter therein, the cavity extending from the first opening toward the second end; and a wind guard slidably coupled to the case body, the wind guard being slidable axially relative to a length of the case body between a retracted position and an extended position, wherein the wind guard comprises a partial cylindrical guard wall defining a central interior space and wherein the guard wall:

defines an access opening for accessing the central interior space; and includes a first side end, a second side end, and for each of the side ends, a side rim portion extending perpendicularly outward from an exterior surface of the guard wall at the side end.

2. The lighter case of claim 1, wherein the case body comprises an elongate tubular member and wherein the central interior space is shaped and sized to receive the elongate tubular member in the retracted position.

3. The lighter case of claim 1, wherein the cavity comprises a bore that extends at least partially through the case body from the first end toward the second end.

4. The lighter case of claim 3, wherein a length of the bore is less than a length of the lighter such that at least a portion of the lighter is exposed beyond the case body when the lighter is received in the bore.

5. The lighter case of claim 4, wherein the length of the bore is such that a flame-producing portion of the lighter is substantially exposed beyond the case body.

6. The lighter case of claim 1, wherein the case body defines one or more guide grooves extending longitudinally on an exterior surface of the case body and wherein the wind guard defines one or more projections corresponding to the guide grooves on an interior surface of the wind guard, each projection being fitted into and sliding in a corresponding guide groove.

7. The lighter case of claim 6, wherein at least one of the guide grooves includes one or more stopper elements therein for limiting sliding movement of a corresponding projection in the at least one guide groove.

8. The lighter case of claim 1, wherein the wind guard includes a cut-away portion on the guard wall at the access opening for accommodating positioning a thumb to ignite the lighter when the wind guard is in the extended position.

9. The lighter case of claim 1, wherein the guard wall includes a rim portion extending perpendicularly outward from a top end of an exterior surface of the guard wall.

10. The lighter case of claim 1, wherein at least one of the case body or the wind guard is constructed out of plastic.

11. The lighter case of claim 1, wherein at least one of the case body or the wind guard is constructed out of a metallic alloy.

12. The lighter case of claim 1, wherein the guard wall defines an interior surface of the wind guard and wherein the interior surface comprises fireproof or fire-resistant material.

* * * * *